US005363966A

United States Patent [19]

Czech et al.

[11] Patent Number: 5,363,966

[45] Date of Patent: Nov. 15, 1994

[54] APPARATUS FOR ATTACHING ARTICLES TO A PLASTIC BAG WALL

[75] Inventors: Norberto Czech; Robert Lauzon, both of Montreal, Canada

[73] Assignee: Glopak Inc., Montreal, Canada

[21] Appl. No.: 134,735

[22] Filed: Oct. 12, 1993

Related U.S. Application Data

[62] Division of Ser. No. 969,371, Oct. 30, 1992, Pat. No. 5,290,391.

[51] Int. Cl.[5] ..... B65D 69/00

[52] U.S. Cl. ..... 206/554; 206/232; 206/831; 383/37

[58] Field of Search ..... 206/232, 459.5, 554, 206/831; 383/37

[56] References Cited

U.S. PATENT DOCUMENTS

| | | | |
|---|---|---|---|
| 3,220,634 | 11/1965 | Rubinstein | 206/459.5 |
| 4,401,213 | 8/1983 | Lerner | 383/37 |
| 4,860,899 | 8/1989 | McKee | 206/459.5 |
| 4,909,636 | 3/1990 | De Matteis et al. | 206/831 |
| 4,988,213 | 1/1991 | Mattle | 206/554 |
| 5,009,518 | 4/1991 | Faltynek | 206/831 |
| 5,035,515 | 7/1991 | Crossman et al. | 206/831 |
| 5,060,793 | 10/1991 | Hyun et al. | 206/232 |
| 5,182,895 | 2/1993 | Lugo | 206/554 |

*Primary Examiner*—Jimmy G. Foster

*Attorney, Agent, or Firm*—Oblon, Spivak, McClelland, Maier & Neustadt

[57] ABSTRACT

A plastic bag bundle comprised of a plurality of juxtaposed flat plastic bags each having a front and rear wall panel and a mouth opening for inserting one or more articles in the bag. A flat article(s), such as coupons, cards, packets, etc., is retained captive in one of the front and rear panels. The bundle is formed of bags having the flat article in some of said bags disposed offset from said article in others of said bags. The bags with the offset articles are interposed in a predetermined sequence with the other bags so as to form a bundle having a generally constant thickness in the area of the juxtaposed panels. Such bag bundles are used in bagging machines where articles are dropped in a first of this bundle of bags which is opened, and wherein the bundle is usually held on wicker pins disposed next to a loading station.

4 Claims, 7 Drawing Sheets

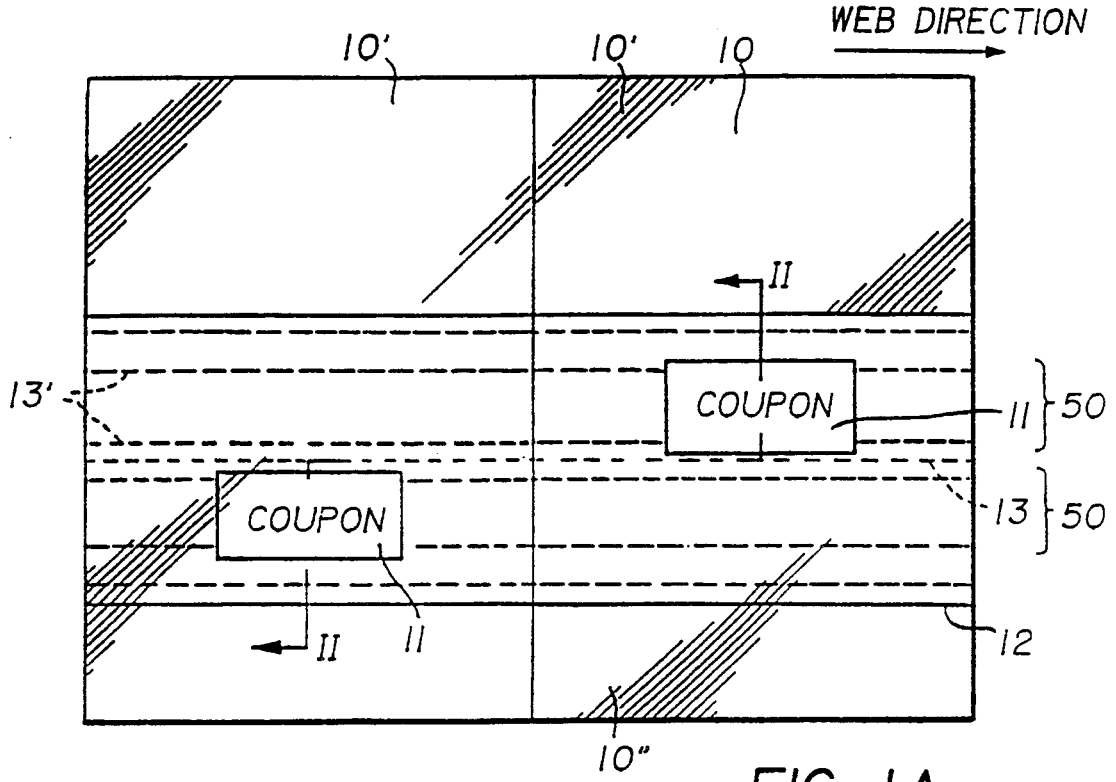
FIG. 1A
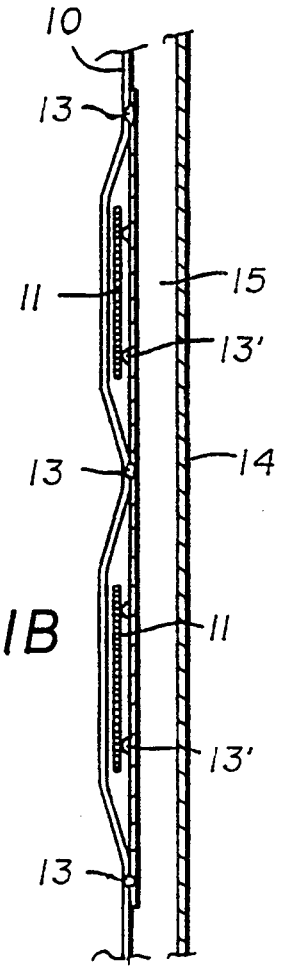
FIG. 1B
FIG. 2A
(PRIOR ART)
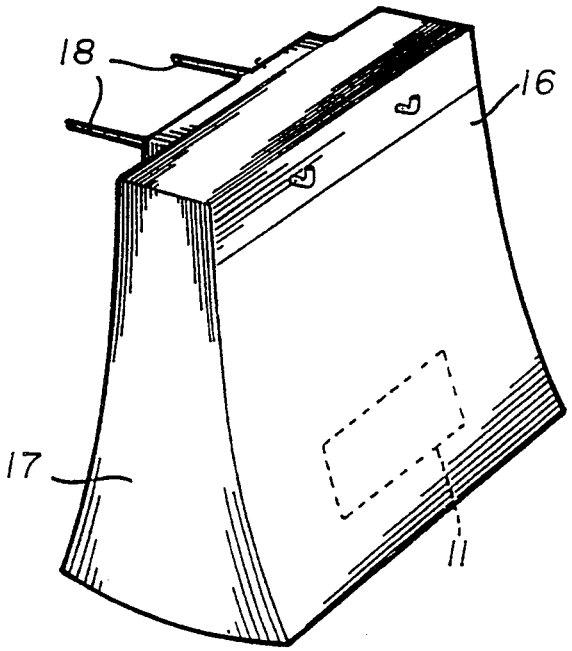

APPARATUS FOR ATTACHING ARTICLES TO A PLASTIC BAG WALL

This is a division of U.S. patent application Ser. No. 07/969,371 filed Oct. 30, 1992 U.S. Pat. No. 5,290,591.

TECHNICAL FIELD

The present invention relates to a plastic bag bundle comprised of a plurality of juxtaposed flat plastic bags having article(s) retained in a wall therein and wherein the article(s) in alternate bags are offset from one another to form a bundle of substantially constant thickness.

BACKGROUND ART

In U.S. Pat. No. 4,268,344 issued May 19, 1981, there is described a method and an apparatus for positioning and securing a coupon within a transparent plastic bag. This coupon is positioned on the bag-forming film sheet and attached thereto by placing an attaching film sheet over the coupon and sealing both sheets together so that the coupon is retained in an immovable position on an inside wall of the bag which is later formed. These coupons are positioned at a common precise position on the bag. We have found that by doing this, there results certain inconveniences. One of these inconveniences is that when the bags are formed to be later supported and attached on wicket pins of a bag-loading machine, the area where the bag has the coupon bulges out and causes an enlargement and deformation of the stack of bags positioned on the wicket pins. This deformation of the stack causes problems in handling the bags in a bag-loading machine. In an attempt to resolve this problem, fewer bags are positioned on the wicket pins. This means that the machine must be stopped more frequently to reload the wicket pins or to correct a malfunction caused by the bulging out of the stack of bags.

Another inconvenience of the above-mentioned prior art bags provided with coupons is that the machine for inserting the coupon is very slow and only between 70 to 80 coupons can be secured to the film every minute. This is caused by the fact that the transfer of coupons is done mechanically in a reciprocating transverse manner.

With the above-mentioned prior art machine, it is only possible to affix a single coupon to a bag wall. There is, however, a need to insert two or more coupons or cards to the same wall of a bag or to affix two flat articles which are different from one another and positioned side by side in a non-interfering manner.

SUMMARY OF INVENTION

It is a feature of the present invention to provide an apparatus and a method for attaching flat articles, cards, packets or the like to a plastic bag wall and which substantially overcomes the above-mentioned disadvantages of the prior art.

Another feature of the present invention is to provide an apparatus and a method for attaching flat articles, cards, packets or the like to a plastic bag wall and wherein the flat articles or packets are positioned in a staggered, non-interfering relationship on alternating bag-forming sections of a film sheet so that when a plurality of bags are formed and suspended on wicket pins, such as in a bag-loading machine, the bags form a substantially uniform stack resulting in more bags being supported on the wicket pins than with prior art bags and fewer malfunctions and machine stoppages.

Another feature of the present invention is to provide an apparatus and a method for attaching flat articles, cards, packets or the like to a plastic bag wall and wherein the article insertion machine inserts the articles in a staggered, alternating relationship and in an in-line manner with relation to the direction of travel of the bag-forming film sheet thereby substantially increasing the insertion speed of the articles, as compared with the above-mentioned prior art machine.

Another feature of the present invention is to provide an apparatus and a method for attaching flat articles, cards, packets or the like to a plastic bag wall at a speed of up to approximately 300 articles per minute and with a capability of being able to match the speed of displacement of the bag-forming film sheet of the insertion machine.

Another feature of the present invention is to provide an apparatus and a method for attaching flat articles, cards, packets or the like to a plastic bag wall and wherein two different articles are attached to the bag wall and spaced from one another.

Another feature of the present invention is to provide a plastic bag bundle comprising a plurality of plastic bags each having article(s), such as coupons, cards, packets, etc. retained captive in a wall thereof and with the bags juxtaposed in alternating sequence wherein articles of alternating bags are offset to form a plastic bag bundle of substantially uniform thickness.

According to the above features, from a broad aspect, the present invention provides a plastic bag bundle which is comprised of a plurality of juxtaposed flat plastic bags, each bag having a front and rear a wall panel and a mouth opening for inserting one or more articles in the bag. One or more articles, such as coupons, cards, packets, etc., is retained captive in one of the front and rear panels. The bundle is formed of bags having these flat articles in some of the bags disposed offset from the article in others of the bags. The bags with said offset articles are interposed in a predetermined sequence with the others of the bags so as to form a bundle having a generally constant thickness in the area of the juxtaposed panels.

BRIEF DESCRIPTION OF DRAWINGS

A preferred embodiment of the present invention will now be described with reference to the accompanying drawings in which:

FIG. 1A is a plan view of the bag-forming film sheet illustrating two panels which will form two bags and wherein flat-like articles, such as coupons, are positioned on each bag-forming panel and at staggered precise locations and retained thereon by an attaching film sheet which is sealed with the bag-forming film sheet;

FIGURE 1B is a section view along section lines II—II of FIG. 1A;

FIG. 2A is a perspective view showing a plurality of bags held on wicket pins and carrying a single coupon as inserted with prior art apparatus;

DESCRIPTION OF PREFERRED EMBODIMENTS

Figure 3:
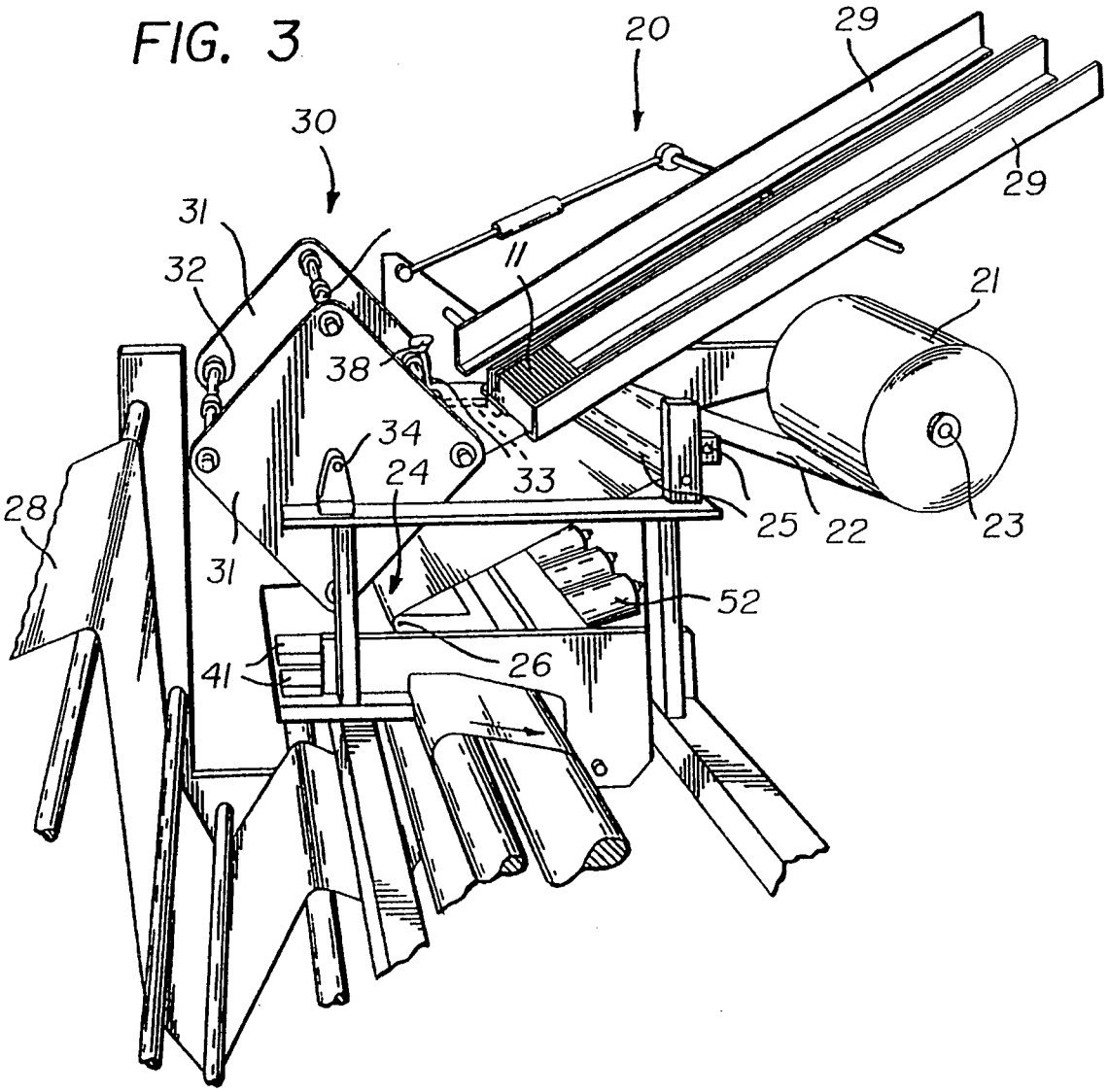
FIG. 3 is a perspective view of the apparatus of the present invention illustrating the manner in which the flat articles are transferred from supply magazines onto associated support surfaces for transfer between the bag-forming film sheet and the attaching film sheet.

Referring now to the drawings and more particularly to FIGS. 1A and 1B, there is shown a bag-forming film sheet 10 defining two bag-forming panels 10' and on each of which flat articles, such as cards, packets, coupons 11 or the like articles have been positioned and secured by an attaching film sheet 12 sealed thereover by a plurality of sealing lines 13 extending longitudinally along the long axis of the bag-forming film sheet 10. Two of the seal lines, namely seal lines 13', extend across the flat article, herein a coupon 11, to immovably retain the coupon between the bag-forming film sheet 10 and the attachment film sheet 12. The cross-section view of FIG. 1B clearly illustrates the manner in which the coupons are held in position. The panel sections 10" are then folded longitudinally and sealed together to form an adjacent side wall 14 of a bag. Accordingly, the coupons 11 are located inside the bag cavity 15, as shown in FIG. 2B.

Figure 2B:
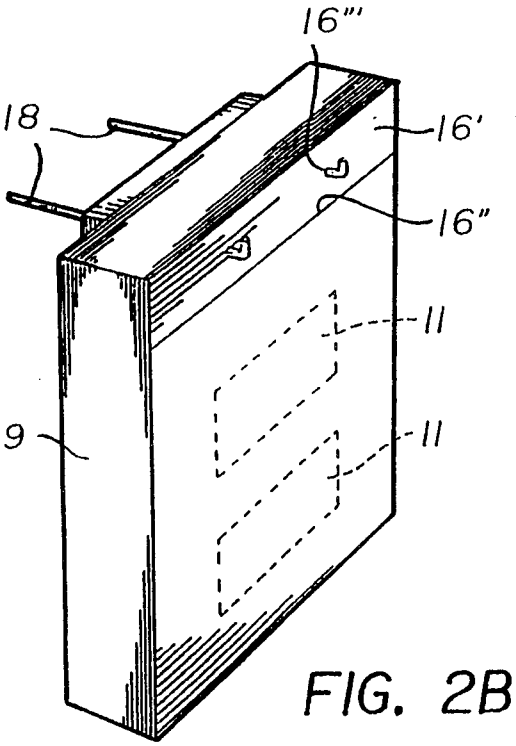
FIG. 2B is a perspective view similar to FIG. 2A but showing a stack of bags having staggered coupons secured thereto.

As shown in FIGS. 2A and 2B, the bags 16 formed by a prior art method, wherein coupons 11 are positioned at a common position, causes a stack of bags supported on wicket pins 18 to bulge out in the area 17 where the coupons are located as the bags are thicker in that area. This bulging out area 17 of the bags when stacked together causes may inconveniences and the end result is that fewer bags can be positioned on the wicket pins 18 which we find in most bag-loading machines. By staggering the coupons 11 at different alternating positions on the bags 10, a bundle 9 of uniform thickness is created and a greater number of bags can be held on the wicket pins, as shown in FIG. 2B. The bundle 9 does not form an enlarged or bulged-out area 17, as illustrated in FIG. 2B. Accordingly, many more bags can be held on the wicket pins 18, with fewer machine malfunctions resulting and fewer machine stoppages to reload.

Referring now additionally to FIGS. 1 to 7, there will be described the construction and operation of the coupon-insertion apparatus 20 of the present invention. As herein shown, in the apparatus, a roll 21 of a attaching film sheet 22 is held on a support rod 23 and guided to an article insertion station 24 by a plurality of guide rolls 25. At the insertion station 24, a nip roll 26 positions the attaching film sheet 22 against a support roll 27 on which a bag-forming film 28 is guided. This is better illustrated in FIG. 4 of the drawings.

Figure 4:
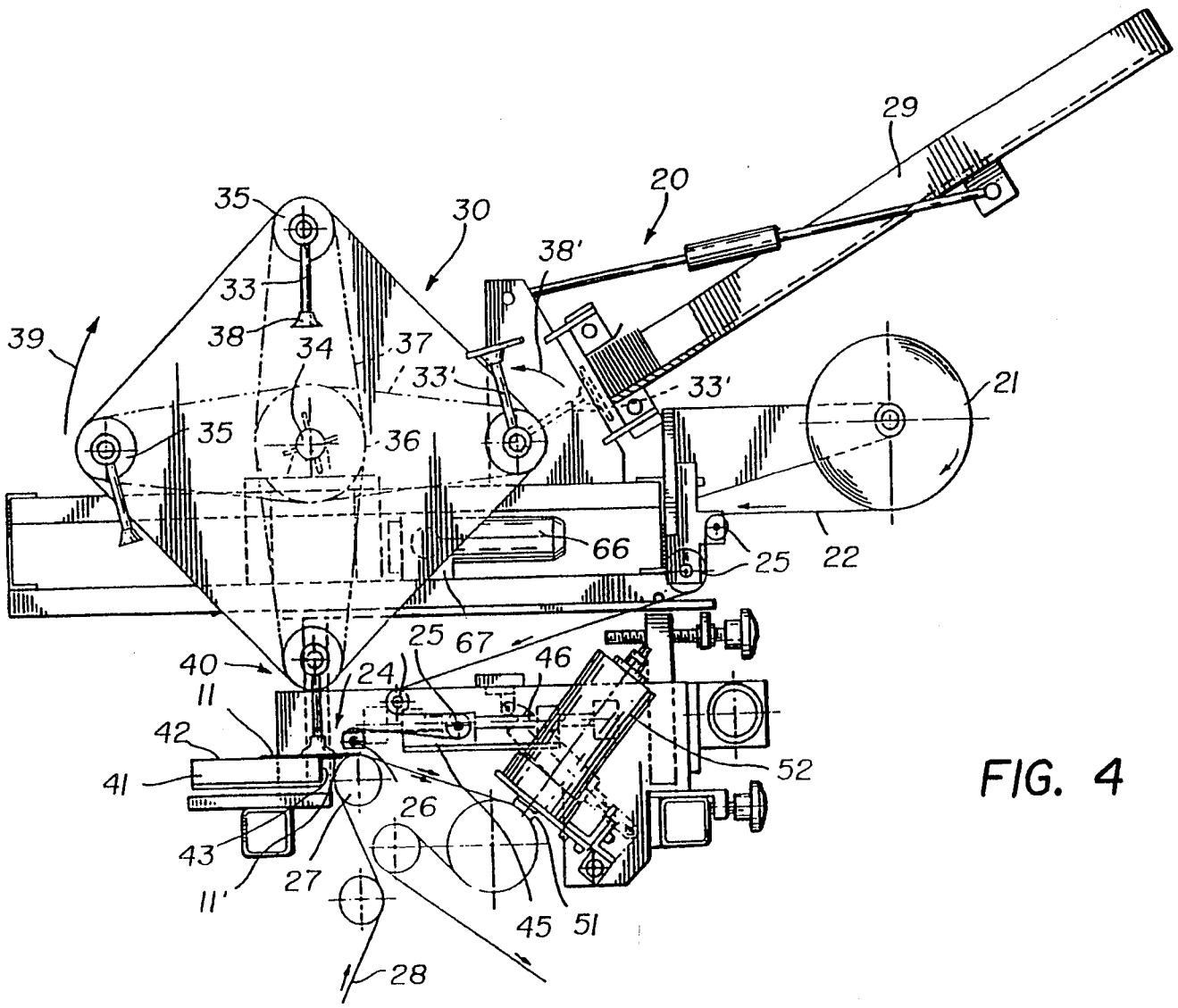
FIG. 4 is a side view illustrating the construction of the apparatus of the present invention and its operation.

In this particular embodiment, two cards or coupons 11, as shown in FIGS. 1A and 1B, are positioned on a side wall panel of the bag-forming film sheet. As previously described, these coupons are fed in-line with the bag-forming sheet 10 and this is made possible by the arrangement of the article transfer mechanism 30 which will now be described. The articles 11 are shown in FIGS. 3 and 4 as contained in two supply magazines 29 which are positioned side by side on top of the machine and supported at an inclined angle by frame members (not shown) and directed towards a discharge end. The article transfer mechanism 30 is a turret mechanism comprised of two spaced apart support walls 31 having transverse support rods 32 and on which is secured a suction grasping element 33. The entire mechanism is rotatable about a central axle 34 to which a planetary gear coupling is connected, as more clearly illustrated in FIG. 4. Planetary gears 35 are coupled to a drive gear 36 connected to the axle 34 and through chain links 37, the support rods 32 are caused to rotate counterclockwise so as to displace the suction grasping elements 33 about the support rods 32 to execute a transfer of articles 11 from the supply magazines 29. The suction grasping elements 33 are connected to a suction pump (not shown) whereby suction can be applied to the suction cup head 38 in a timed manner as dictated by the control circuit illustrated in FIG. 8.

Figure 6:
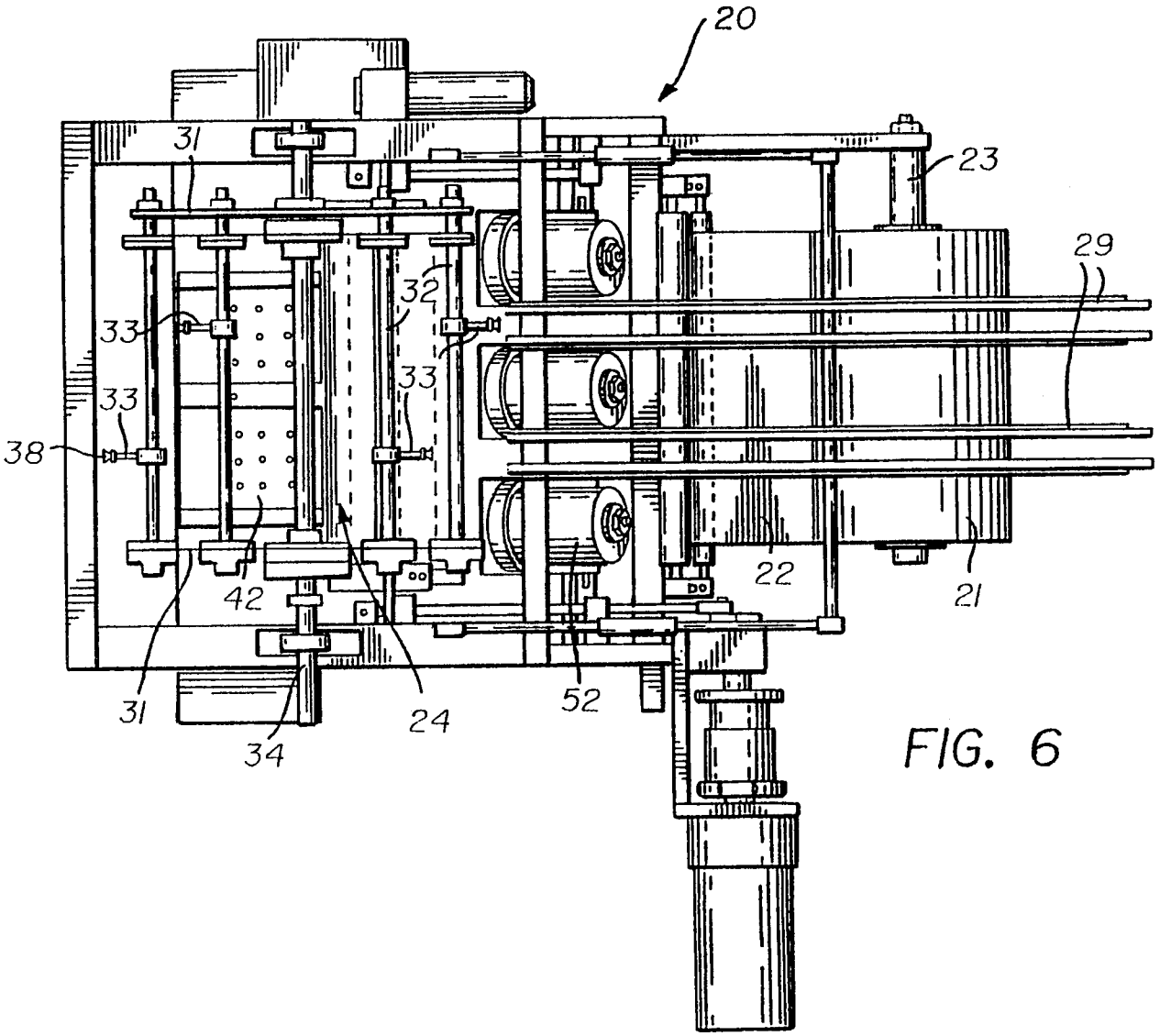
FIG. 6 is a view similar to FIG. 5 but illustrating the relationship of the supply magazines in relation to the support surfaces and sealing heads.

As shown in FIG. 6, the grasping elements on alternate support rods 32 are positioned offset from one another and aligned with a respective one of two support surfaces 42 or article holding means which are in turn aligned with distinct sections of the film sheet 22. When the suction element is at its position 33' (see FIG. 4), suction is applied to the suction head 38 and the outermost element 11 is grasped from the discharge end of one of the magazines 29. As the turret continues to rotate in a clockwise direction, as illustrated by arrow 39, the next suction element will grasp an article from the other magazine. The suction grasping elements 33 are displaced in a rotating counterclockwise manner, as shown by arrow 38', and the vacuum is maintained to rigidly retain the article 11 on the suction cup head 38 until it reaches its unloading position 40 where the cup head 38 is disposed vertically downward and over the support surface 42 of a vacuum chamber 41. The surface 42 is perforated to retain the elements 11 positioned thereover. Although the surface 42 herein described has a vacuum applied thereto, this may not be required due to the precise synchronism of the turret, film speed and grasping nip roll.

As shown in FIG. 4, the card-like article 11 is positioned with a leading edge 11' thereof extending over the side wall 43 of the suction box 41 and retained in this position by the continuous vacuum applied to the article 11 thereon. As soon as the article 11 is positioned on the support surface 42, it is retained by the suction applied to the surface 42. The suction from the suction cup head 38 is immediately cut off as the turret continues to rotate and all this is done within a split second. The leading edge 11' of the article 11 rests over a portion of the support roll 27 but is not drawn by the rotation of the bag-forming film sheet 28 as the suction in the suction box is greater than the friction force on the leading edge of the article 11.

Figure 7:
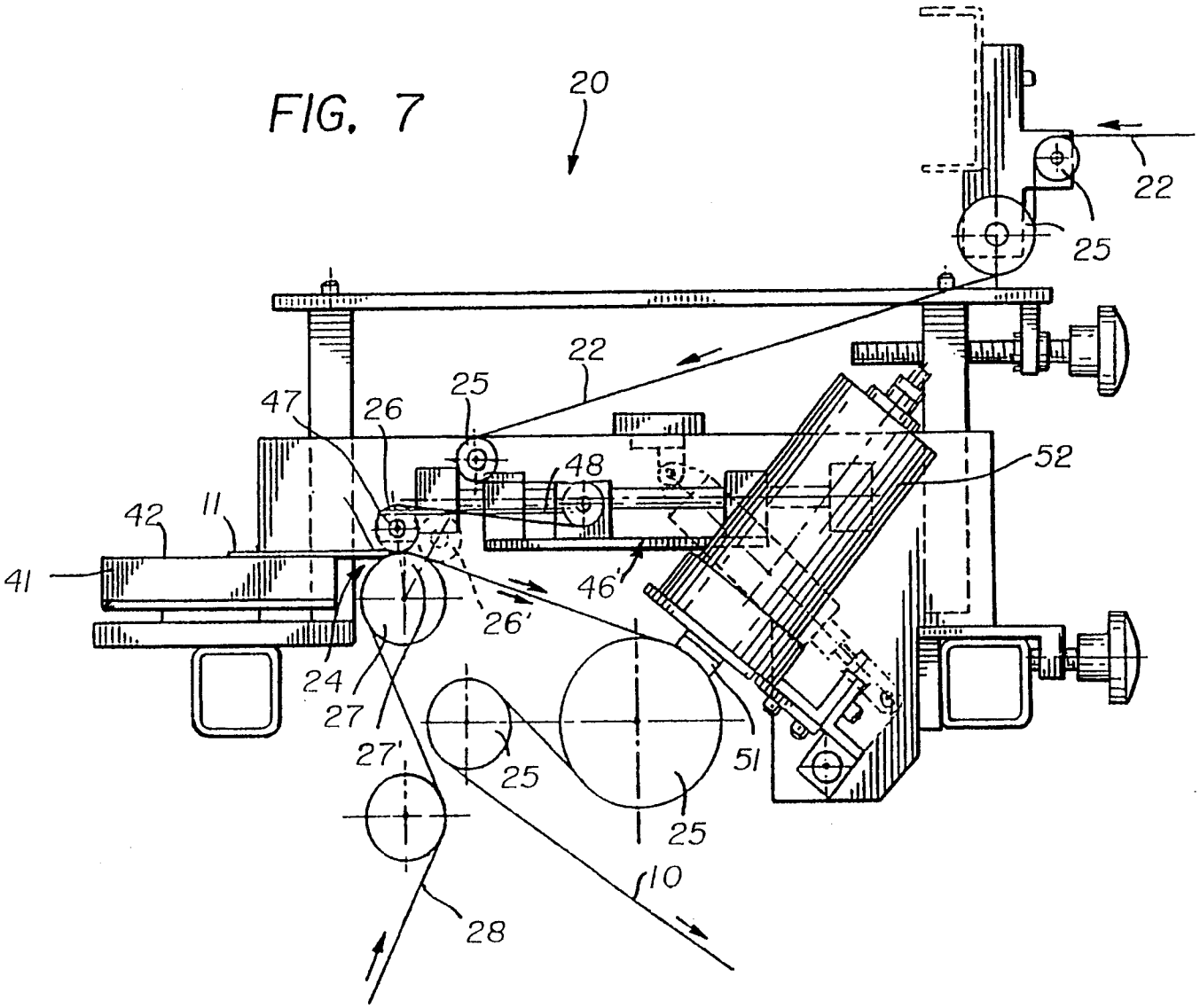
FIG. 7 is a schematic side view illustrating the relationship of the films with respect to the support surface and the manner in which the articles are grasped and fed between the bag-forming film sheet and the attaching film sheet.
Figure 8:
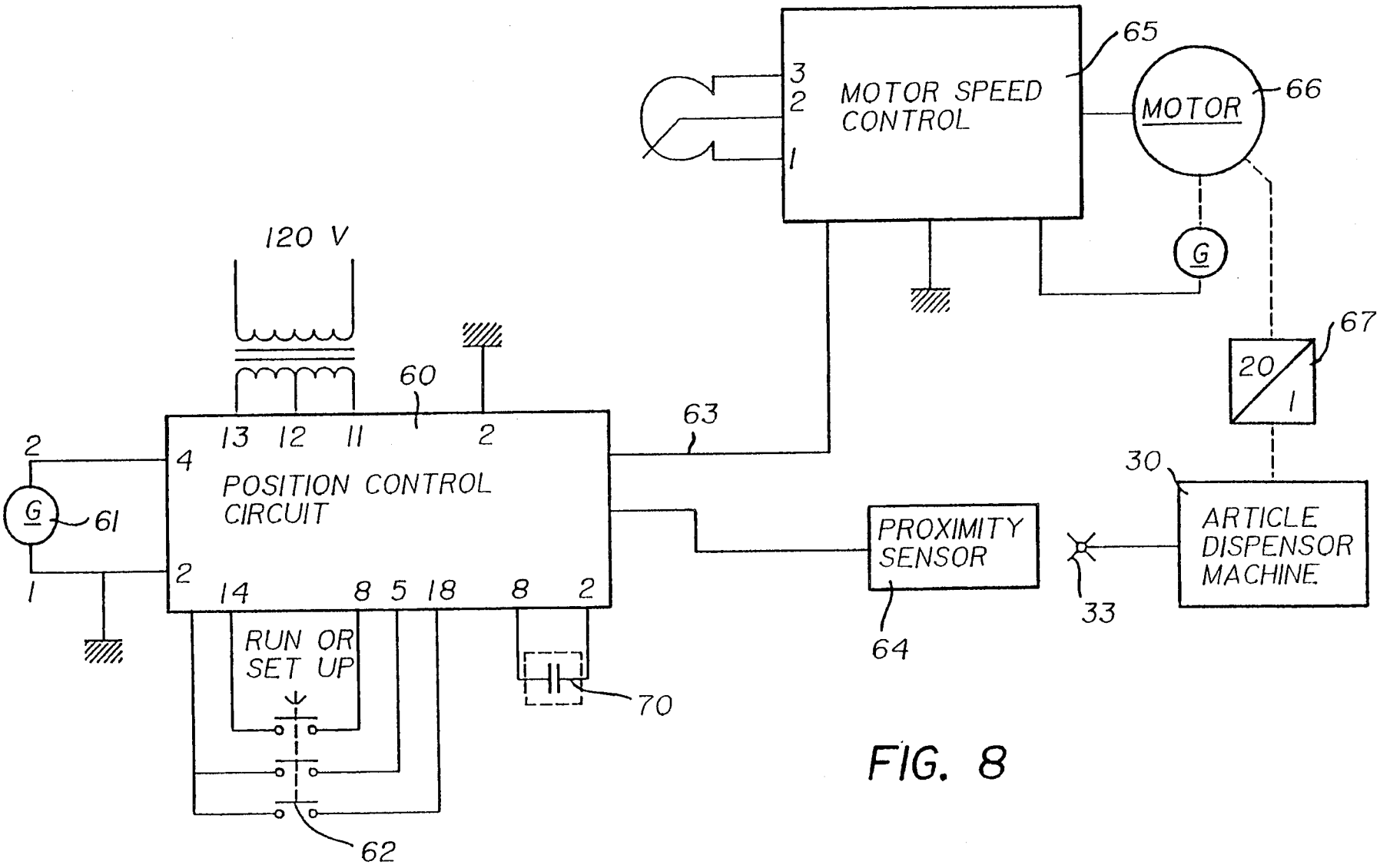
FIG. 8 is a block diagram showing the control system for the apparatus of the present invention.

Sensing means in the form of a photocell 70, as shown in FIG. 8, detects index markings on the bag-forming film sheet 28 and synchronizes the operation of the bag transfer mechanism 30, the suction box 41 and the operation of the nip roll 26. As shown in FIGS. 4 and 7, the nip roll 26 is secured to a support block 45 connected to a clutch mechanism 69 (see FIG. 5) and moves in a reciprocating manner to position the nip roll 26 from a non-grasping position 26′ (see FIG. 7) to a grasping position as shown in FIGS. 4 and 7. The nip roll 26 is supported on an axle 47 which is secured at its opposed ends to flexible support arms 48 formed of spring steel. The nip roll 26 is aligned for frictional contact with the support block roll 27. By adjusting the angle of the support block 45, we can adjust the biasing pressure of the nip roll 26 against the support roll 27. As the nip roll is displaced from its position 26′ (see FIG. 7) to its grasping position 26, it moves along a bag-grasping segment 27′ of the support roll 27 to grab the leading edge 11′ of the article 11 and draw the article 11 off the surface 42 and position it between the bag-forming film sheet 28 and the attaching film sheet 22 at a precise location, as shown in FIG. 1A. There are two suction blocks and support surfaces 42 positioned side by side, as shown in FIG. 5, and aligned with distinct areas or sections 50 of the bag-forming film sheet 28, as shown in FIG. 1A.

Figure 5:
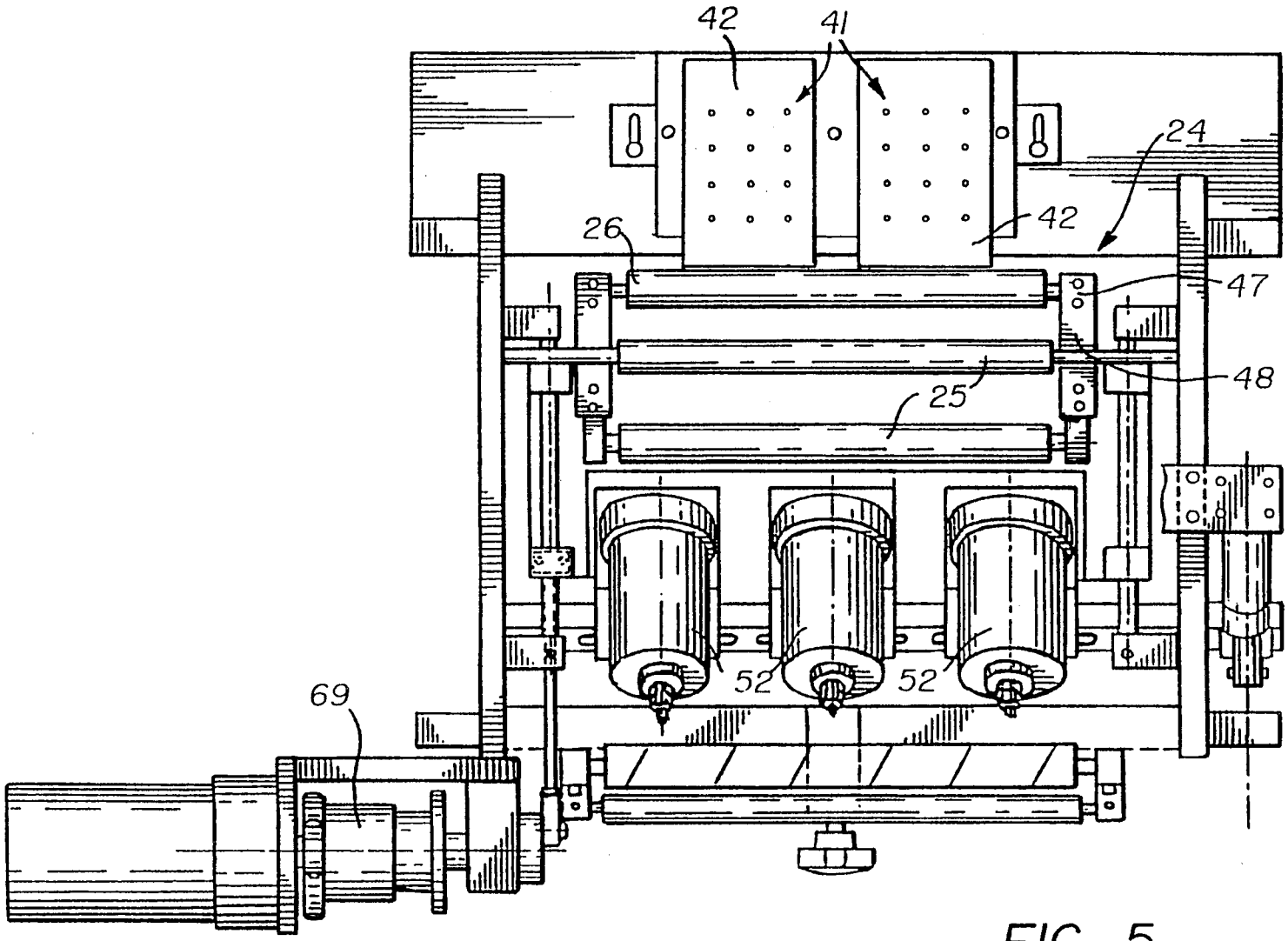
FIG. 5 is an end view showing the position of the support surfaces and their relationship with the sealing heads.

As more clearly illustrated in FIGS. 5 and 6, both film sheets 22 and 28 having the articles 11 held by friction therebetween, are then fed to a sealing station where hot air sealing heads 51 of each sealing device 52 apply fusing lines 13 and 13′ to seal the attaching film sheet 22 to the bag-forming film sheet 28 and at the same time secure the article or coupons 11 therebetween. The composite bag-forming film sheet 10 is then fed to a bag-forming station (not shown where bags are formed from the panels 10′, as illustrated in FIG. 1B.

Referring now to FIG. 8, there is schematically illustrated the control system which is integrated with the apparatus 20 of the present invention. The control system consists of a position control circuit 60 to which a signal from the photocell 45 is applied. The control circuit 60 has a memory circuit, not shown, and which is obvious to a person skilled in the art, and controls the speed of the turret 30 by following the speed of the bag-forming film 28 via the tachometer 61. The operation of the system is actuated by the switch 62. The operation of the article transfer mechanism 30 is controlled by an automatic speed signal on the output line 63 of the position control circuit 60 which is transmitted after additionally processing a signal fed to it by a proximity sensor 64 associated with the turret transfer mechanism and which detects the position of the suction grasping elements 33. The output signal at output 63 is fed to a controller circuit 65 which controls the motor 66 thereby controlling the speed of operation of the turret mechanism. A reducer 67 couples the motor drive to the transfer mechanism 30. Accordingly, with the use of the photocell 45 which senses exact positions on the bag-forming film sheet, and the proximity sensor 64 which senses the position of the suction-grasping elements 33, it is possible to synchronize the speed of the films and the coupon transfer speed. With this apparatus, 200–300 coupons can be positioned every minute. The application of vacuum to the suction cups of the grasping elements is synchronized to the speed of the films. The fact that articles are positioned side by side in a staggered arrangement also permits the article insertion speed to be greatly increased.

As can be appreciated with the present invention, it is also possible to insert articles in transversely aligned relationship whereby two articles are positioned side by side, in a non-interfering manner, on the same bag-forming panel 10′. If this is desirable, each of the support rods 32 could be fitted with two suction grasping elements 33 and the nip roll 26 would be activated each time two coupons are deposited in the surfaces 42.

Briefly summarizing the operation of the present invention, a bag-forming film sheet 28 is fed to a nip roll 26 positioned at an article insertion station 24 and which is in frictional rotational contact with a support roll 27 over which an attaching film sheet 22 is guided for facial contact with the bag-forming film sheet 28. Articles 11, such as cards, coupons or flat packets, are then transferred from supply magazines 29 by the respective transfer mechanisms 30 to respective ones of two or more, herein two, article holding 14 surfaces 42. These surfaces are perforated vacuum surfaces capable of retaining an article 11 at a precise position as dictated by the position of the suction-grasping elements 33. These surfaces 42 are each positioned side by side and aligned with a distinct area or section of the bag-forming film sheet 28, as shown in FIGS. 5 and 6. The articles are supported on the surfaces 42 by vacuum with a leading edge 11′ of the articles 11 being placed at a grasping position with a leading edge portion 11′ of the article extending over a portion of the support roll 27. The nip roll 26 is then displaced over a grasping segment 27′ of the support roll 27 in a direction towards the leading edge 11′ of the article 11 to grasp the article and pull it between the bag-forming film sheet and the attaching film sheet along an associated one of the two distinct areas or sections 50 (see FIG. 1A) of the film sheet. The articles are then captive between the film sheets 22 and 28 and are secured by heat seals formed between the two film sheets. The film can then be fed to a supply roll for use on a bag-forming machine where a bag is then formed by a forming section of the machine (not shown).

It is also pointed out that the tension or pressure between the nip roll 26 and the support roll 27 can be adjusted by adjusting the tilt angle of the assembly 46′. It is also pointed out that for purpose of illustration, the vacuum chambers 41 are herein illustrated as being larger than they actually are and the relationship between the sealing devices 52 and the film support rolls 25 are of distorted proportions in these drawings. This is obvious when comparing the drawings of FIG. 1A with, for example, FIGS. 5 and 6.

As above described the present invention provides a plastic bag bundle 9, as shown in FIG. 2B, wherein the bundle is of substantially uniform thickness. This is accomplished by stacking the bags in an alternating sequence with coupons of adjacent bags being placed adjacent one another. Accordingly the problem of the prior art as illustrated in FIG. 2A is obviated. It is also pointed out that the bags may be positioned in alternating groups, i.e., two or three bags with coupons of each group offset from coupons of the adjacent groups. Accordingly, more bags can be held on the wicket pins 18 which means that the wicket pins need not be reloaded as frequently as with the prior art. Also, with the prior art the fact that the bottom portion of the bags flare outwardly, also results in machine malfunction and therefore it is necessary to stop the machine and realign the bags, and this is costly. The bags as specifically illustrated in FIG. 2B are formed with a wicket attaching panel 16′ formed in the rear wall panel of the bag and extending above the mouth opening 16″. Holes 16‴ are formed in the attaching panel for supporting the bag bundle on the wicket pins 18.

It is within the ambit of the present invention to cover any other obvious modifications not mentioned herein, provided such modifications fall within the scope of the appended claims.

We claim:

1. A plastic bag bundle comprising a plurality of juxtaposed flat plastic bags, each bag having a front and rear wall panel and a mouth opening for inserting one or more articles in said bag, at least one flat article retained captive in one of said front and rear panels, said bundle being formed of bags having said flat article in some of said bags disposed offset from said flat article in others of said bags, said bags with said offset flat article being interposed in a predetermined sequence with said others of said bags so as to form a bundle having a generally constant thickness in the area of said juxtaposed panels.

2. A plastic bag bundle as claimed in claim 1 wherein said flat article is offset and in alignment with one another, said flat article being retained captive behind one of said front and rear wall panels by an attaching film sheet.

3. A plastic bag bundle as claimed in claim 2 wherein said attaching film sheet is attached to said one of said front and rear wall panels by heat seals, said seals maintaining said article captive.

4. A plastic bag bundle as claimed in claim 2 wherein said plastic bags are provided with a wicket attaching panel formed in said rear wall panel and extending above said mouth opening defined at a top edge of said front wall panel, and perforation means in said attaching panel for supporting said bag bundle from said attaching panel.

* * * * *